US007910276B2

(12) United States Patent
Moffat et al.

(10) Patent No.: US 7,910,276 B2
(45) Date of Patent: Mar. 22, 2011

(54) TONER COMPOSITIONS

(75) Inventors: Karen A. Moffat, Brantford (CA); Juan A. Morales-Tirado, West Henrietta, NY (US); Thomas P. Debies, Webster, NY (US); William H. Hollenbaugh, Jr., Rochester, NY (US); Emily L. Moore, Mississauga (CA); Nancy S. Hunt, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 897 days.

(21) Appl. No.: 11/776,777

(22) Filed: Jul. 12, 2007

(65) Prior Publication Data

US 2009/0017393 A1 Jan. 15, 2009

(51) Int. Cl.
*G03G 9/00* (2006.01)

(52) U.S. Cl. ..... 430/108.8; 430/109.3; 430/109.4; 430/124.1; 430/137.14

(58) Field of Classification Search ..... 430/108.8, 430/109.3, 109.4, 124.1, 137.14
See application file for complete search history.

(56) References Cited

U.S. PATENT DOCUMENTS

| | | | | |
|---|---|---|---|---|
| 5,290,654 | A | 3/1994 | Sacripante et al. | |
| 5,308,734 | A | 5/1994 | Sacripante et al. | |
| 5,370,963 | A | 12/1994 | Patel et al. | |
| 5,409,557 | A | 4/1995 | Mammino et al. | |
| 5,487,707 | A | 1/1996 | Sharf et al. | |
| 5,514,436 | A | 5/1996 | Schlueter, Jr. et al. | |
| 5,593,807 | A | 1/1997 | Sacripante et al. | |
| 6,387,581 | B1 | 5/2002 | Moffat et al. | |
| 6,395,445 | B1 | 5/2002 | Toth et al. | |
| 6,447,974 | B1 | 9/2002 | Chen et al. | |
| 2004/0137357 | A1 | 7/2004 | Bartel et al. | |
| 2006/0166121 | A1 | 7/2006 | Patel et al. | |
| 2006/0228639 | A1 | 10/2006 | Young et al. | |
| 2007/0059049 | A1 * | 3/2007 | Onuma et al. | 399/284 |
| 2007/0141496 | A1 | 6/2007 | Vanbesien et al. | |

FOREIGN PATENT DOCUMENTS

| | | | |
|---|---|---|---|
| EP | 1 681 598 | A2 | 7/2006 |
| EP | 1 785 773 | A1 | 5/2007 |

OTHER PUBLICATIONS

European Search Report, dated Jul. 23, 2010, in European Patent Application No. 08156443.7.

Canadian Office Action mailed Oct. 19, 2010 in related Canadian Application No. 2,636,808.

* cited by examiner

*Primary Examiner* — Mark A Chapman
(74) *Attorney, Agent, or Firm* — Oliff & Berridge, PLC

(57) ABSTRACT

Disclosed herein are emulsion aggregation toner particles having less than about 15 atomic percent oxygen in relation to a total atomic percent of 100 for all elements on the surface thereof. Such toner particles exhibit lower marks on print defects.

18 Claims, No Drawings

TONER COMPOSITIONS

BACKGROUND

Disclosed herein is an emulsion aggregation toner with improved design parameters, such that the toner may exhibit lower marks on print defects.

REFERENCES

Toner compositions and processes, such as emulsion aggregation toner processes for preparing toner compositions comprising a binder, a wax and a colorant are known in the art.

The emulsion aggregation (EA) process includes the aggregation of various toner components from a starting latex of the components, followed by the coalescence of the particles at elevated temperature. The components incorporated into the toner are chosen to provide necessary requirements for the final toner particle. For example, a colorant may be added for color, a wax may be added to provide release from the fuser roll for oil-less fuser systems, and a binder resin may be designed to provide a low minimum fusing temperature (MFT). Another toner property which may be controlled by the components of the EA toner particles is fused image gloss. This property may be particularly important when designing EA toners for providing low gloss or matte images.

It is still desired to improve the components and design parameters of EA toners in order decrease the marks on copy print defect of printed images formed from EA toner. The marks on copy print defect refers to fused black specks and smears on the backside of high area coverage prints.

SUMMARY

Herein, it was determined that the occurrence of print defects such as marks on copy print are associated with the amount of wax on the surface of the EA toner particles. Thus, it is desired to accurately measure and control the amount of wax on the surface of the EA toner particles and to reproducibly produce EA toner particles having a suitable amount of wax on the surface of the toners.

In embodiments, described herein are toner particles comprising a wax, a binder resin and a colorant, wherein a surface of the toner particles comprises less than 15 atomic percent oxygen in relation to a total atomic percent of 100 for all elements on the surface of the toner particles.

In further embodiments, described is an process for making an emulsion aggregation toner particle, comprising mixing a binder resin, a wax and a colorant; aggregating particles to a size from about 3 to about 20 microns; halting the aggregation of the particles; coalescing the particles to form toner particles; and measuring the atomic percent oxygen on a surface of the toner particles and controlling the atomic percent oxygen on the surface of the toner particles whereby the surface of the toner particles comprises less than 15 atomic percent oxygen in relation to a total atomic percent of 100 for all elements on the surface of the toner particle.

In yet further embodiments, described is image forming process, comprising forming an electrostatic image on a photoconductive member; developing the electrostatic image to form a visible image by depositing emulsion aggregation toner particles on a surface of the photoconductive member; and transferring the visible image to a substrate and fixing the visible image to the substrate with a fuser member; wherein the emulsion/aggregation toner comprises a binder resin, a wax, and a colorant, wherein the surface of the toner particle comprises less than 15 atomic percent oxygen in relation to a total atomic percent of 100 for all elements on the surface of the toner particle, and wherein the fuser member is a hard fuser member or comprises a substrate and an outer layer comprising a fluoropolymer.

EMBODIMENTS

The EA toner disclosed herein comprises a wax, a binder resin, and an optional colorant.

Examples of waxes suitable for use herein include any waxes that are substantially free of oxygen, for example, aliphatic waxes such as hydrocarbon waxes having about 1 carbon atom to about 30 carbon atoms, such as from about 1 carbon atom to about 30 carbon atoms or from about 1 carbon atom to about 25 carbon atoms, polyethylene, polypropylene or mixtures thereof. Waxes that are suitable for use herein have a molecular weight (Mn) of from about 100 to about 5,000, such as from about 200 to about 4,000 or from about 400 to about 3,000. Example waxes include the line of waxes, such as POLYWAX 500 (Mn=500), POLYWAX 655 (Mn=655), POLYWAX 725 (Mn=725), POLYWAX 850 (Mn=850), POLYWAX 1000 (Mn=1,000), and the like.

More specific examples of waxes suitable for use herein include polypropylene and polyethylene waxes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. Commercially available polyethylenes possess, it is believed, a molecular weight (Mw) of about 1,000 to about 5,000, and commercially available polypropylenes are believed to possess a molecular weight of about 4,000 to about 10,000. Examples of functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™ POLYFLUO 523XF™, AQUA POLYFLUO 411™, AQUA POLYSILK 19™, and POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson Wax.

In embodiments, the wax comprises a wax in the form, of a dispersion comprising, for example, a wax having a particle diameter of from about 100 nanometers to about 500 nanometers, water, and an anionic surfactant. In embodiments, the wax is included in amounts such as from about 2 to about 40 weight percent. The amount of wax present in the toner particle formulation may be from about 3 weight percent to about 15 weight percent of the total toner particle formulation weight, such as from about 4 weight percent to about 13 weight percent or from about 3 weight percent to about 12 weight percent of the total toner particle formulation weight. In embodiments, the wax comprises polyethylene wax particles, such as POLYWAX 850, POLYWAX 750 and POLYWAX 655, commercially available from Baker Pletrolite, having a particle diameter in the range of about 100 to about 500 nanometers.

The toner particles disclosed herein also include a binder resin. The binder resin disclosed herein may be styrene/acrylate resin, and may be a high glass transition temperature (Tg) latex and a gel latex.

For example, the high Tg latex comprises latex comprising monomers, such as styrene, butyl acrylate, and beta-carboxyethylacrylate (beta-CEA) monomers prepared, for example, by emulsion polymerization in the presence of an initiator, a chair transfer agent (CTA), and surfactant.

Instead of beta-CEA, the high Tg latex may include any carboxyl acid containing monomer, such as maleic acid, citraconic acid, itaconic acid, alkenyl succinic acid, fimaric acid, mesaconic acid, maleic-acid anhydride, citraconic anhydride, itaconic-acid anhydride, alkenyl succinic-acid anhydride, maleic-acid methyl half ester, maleic-acid ethyl half ester, maleic-acid butyl half ester, citraconic-acid methyl half ester, citraconic-acid ethyl half ester, citraconic-acid butyl half ester, itaconic-acid methyl half ester, alkenyl succinic-acid methyl half ester, furnaric-acid methyl half ester, half ester of the partial saturation dibasic acid such as mesaconic acid methyl half ester, dimethyl maleic acid, the partial saturation dibasic acid ester such as dimethlyl furnaric acid, acrylic acid, methacrylic acid, alpha like crotonic acid, cinnamon acid, beta-partial saturation acid, crotonic-acid anhydride, cinnamon acid anhydride, alkenyl nalonic acid, a monomer which has an alkenyl glutaric acid, and alkenyl adipic acids.

In embodiments, the high Tg latex comprises styrene:butyl acrylate:beta-CEA wherein, for example, the high Tg latex monomers include from about 70 weight percent to about 90 weight percent styrene, from about 10 weight percent to about 30 weight percent butyl acrylate, and from about 0.05 weight percent to about 10 weight percent beta-CEA.

In embodiments, the toner comprises high Tg latex in an amount of from about 50 weight percent to about 95 weight percent of the total weight of the toner described herein, such as 65 weight percent to about 80 of the total weight of the toner described herein.

The high Tg latex disclosed herein may be substantially free of crosslinking and may have crosslinked density less than about 0.1 percent, such as less than about 0.05. As used herein "crosslink density" refers to the mole fraction of monomer units that are crosslinking points. For example, in a system where 1 of every 20 molecules is a divinylbenzene and 19 of every 20 molecules is a styrene, only 1 of 20 molecules would crosslink. Thus, in such a system, the crosslinked density would be 0.05.

The onset Tg (glass transition temperature) of the high Tg latex may be from about 53° C. to about 70° C., such as from about 53° C. to about 67° C. or from about 53° C. to about 65° C., or such as about 59° C.

The weight average molecular weight (Mw) of the high Tg latex may be from about 20,000 to about 60,000, such as from about 30,000 to about 40,000.

The gel latex may be prepared from a high Tg latex, such as a latex comprising monomers of styrene, butyl acrylate, beta-CEA, divinylbenzene, a surfactant and an initiator. The gel latex may differ from the high Tg latex in at least its crosslinked density. Further, instead of the beta-CEA, the gel latex may include a carboxyl acid containing monomer as described above. The gel latex may be prepared by emulsion polymerization.

In embodiments, the crosslinked density of the gel latex is from about 0.3 percent to about 40 percent, such as from about 0.3 percent to about 35 percent or from about 0.3 percent to about 30 percent crosslinked density.

In embodiments, the toner comprises gel latex in an amount of from about 3 weight percent to about 30 weight percent of the total weight of the toner described herein, such as 5 weight percent to about 15 of the total weight of the toner described herein.

Other latexes suitable for preparing the high Tg latex and the gel latex include styrene acrylates, styrene methacrylates, butadienes, isoprene, acrylonitrile, acrylic acid, methacrylic acid, beta-carboxy ethyl acrylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methlacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/beta-carboxyethylacrylate terpolymer.

An initiator suitable for use in producing both the gel latex and the high Tg latex may be, for example, sodium, potassium or ammonium persulfate and may be present in with both the crosslinking starting monomers and non-crosslinking starting monomers in the range of from about 0.1 weight percent to about 5 weight percent, such as from about 0.3 weight percent to about 4 weight percent or from about 0.5 weight percent to about 3 weight percent of an initiator based upon the total weight of the monomers. In embodiments, the surfactant may be present in the range of from about 0.3 weight percent to about 10 weight percent, such as from about 0.5 weight percent to about 8 weight percent or from about 0.7 to about 5.0 weight percent of surfactant.

Both the gel latex and the high Tg latex may be produced by similar methods. However, in producing the high Tg latex, no divinylbenzene or similar crosslinking agent is used. Examples of crosslinking agents suitable for making the gel latex include divinylbenzene, divinylnaphthalene, ethylene glycol diacrylate, 1,3-butylene-glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethyleneglycol #400 diacrylate, dipropylene glycol diacrylate, and polyoxyethylene (2)-2,2-bis(4-hydroxyphenyl) propane diacrylate. The gel latex and high Tg latex may be made by any suitable method. One example of a suitable method is described below for illustration.

First, a surfactant solution is prepared by combining a surfactant with water. Surfactants suitable for use herein may be anionic, cationic or nonionic surfactants in effective amounts of, for example, from about 0.01 to about 15, or from about 0.01 to about 5 weight percent of the reaction mixture.

Anionic surfactants include sodium dodecylsulfate (SDS), sodium dodecylbenizene sulfonate, sodium dodecylbenzene sulfonate, sodium dodecylnaphthalene sulfate, dialkyl benzenealkyl, sulfates and sulfonates, abitic acid, available from Aldrich, NEOGEN R™, NECOGEN SC™ obtained from Kao, and the like.

Examples of cationic surfactants include dialkyl benzene alkyl amnonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, SANIISOL B-50 available from Kao Corp., which consists primarily of benzyl dimethyl alkonium chloride, and the like.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octylether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhono-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and mixtures thereof.

In a separate container, an initiator solution is prepared. Examples of initiators for the preparation of the latex include water soluble initiators, such as ammonium and potassium persulfates in suitable amounts, such as from about 0.1 to about 8 weight percent, and more specifically, in the range of from about 0.2 to about 5 weight percent. The latex includes both the initial latex and the added delayed latex wherein the delayed latex refers, for example, to the latex portion which is added to the already preformed aggregates in the size range of about 4 to about 6.5 μm, as described below.

In yet another container, a monomer emulsion is prepared by mixing the monomer components of the latex, such as styrene, butyl acrylate, beta-CEA, optionally divinylbenzene if producing the gel latex, and surfactant. In one embodiment, the styrene, butyl acrylate, and/or beta-CEA are olefinic monomers.

Once the preparation of the monomer emulsion is complete, a small portion, for example, about 0.5 to about 5 percent of the emulsion, may be slowly fed into a reactor containing the surfactant solution. The initiator solution may be then slowly added into the reactor. After about 15 to about 45 minutes, the remainder of the emulsion is added into the reactor.

After about 1 to about 2 hours but before all of the emulsion is added to the reactor, 1-dodecaniethiol or carbon tetrabromide (chain transfer agents that control/limit the length of the polymer chains) is added to the emulsion. In embodiments, the charge transfer agent may be used in effective amounts of, for example, from about 0.05 weight percent to about 15 weight percent of the starting monomers, such as from about 0.1 weight percent to about 13 weight percent or from about 0.1 weight percent to about 10 weight percent of the starting monomers. The emulsion is continued to be added into the reactor.

The monomers may be polymerized under starve fed conditions as referred to in U.S. Pat. No. 6,447,974, incorporated by reference herein in its entirety, to provide latex resin particles having a diameter in the range of from about 20 nanometers to about 500 nanometers, such as from about 75 nanometers to about 400 nanometers or from about 100 to about 300 nanometers.

Colorants or pigments include pigments, dyes, mixtures of pigments and dyes, mixtures of pigments, mixtures of dyes, and the like. In embodiments, the optional colorant comprises a pigment, a dye, mixtures thereof, carbon black, magnetite, black, cyan, magenta, yellow, red, green, blue, brow, mixtures thereof, in an amount of about 1 weight percent to about 25 weight percent by weight based upon the total weight of the toner composition, such as from about 2 weight percent to about 20 weight percent or from about 5 weigh percent to about 15 weight percent based upon the total weight of the toner composition. It is to be understood that other useful colorants will become readily apparent to one of skill in the art based on the present disclosure.

In general, useful optional colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Don Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow L (Hoechst), Permanerit Yellow YE, 0305 (Paul Uhlrich), Lumogen Yellow D0790 (BASF). Suco-Gelb 1250 (BASF), Suco-Yellow D1355 (BASF), Suco Fast Yellow D1165. D 1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional optional colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE, BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example. HOSTAFINE Yellow GR, HOSTAFINE Black T and Black TS, HOSTAFINE Blue B2G. HOSTAFINE Rubine F6B and magenta dry pigment such as Toner Magenta 6BVP2213 and Toner Magenta EO2 which can be dispersed in water and/or surfactant prior to use.

Other optional colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst and CINQUASIA MAGENTA available from E.I. DuPont de Nemours & Company, and the like. Examples of magentas include, for example, 2,9-dimethyl substituted quinacridone and anthraqulinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phtlhalocyanine, x-copper phthalocyamine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2, 4-dimethoxy acetoacetanilide, and Permanent Yellow FGL. Colored magnetites, such as mixtures of MAPICO BLACK and cyan components may also be selected as pigments.

The toner particles may be made by any known emulsion aggregation process. An example of such a process suitable for use herein includes forming a mixture of the high Tg latex, the gel latex, wax and optional colorant, and deionized water in a vessel. The mixture is then stirred using a homogenizer until homogenized and then transferred to a reactor where the homogenized mixture is heated to a temperature of, for example, about 50° C. and held at such temperature for a period of time to permit aggregation of toner particles to the desired size. Once the desired size of aggregated toner particles is achieved, the pH of the mixture is adjusted in order to inhibit further toner aggregation. The toner particles are further heated to a temperature of, for example, about 90° C. and the pH lowered in order to enable the particles to coalesce and spherodize. The heater is then turned off and the reactor mixture allowed to cool to room temperature, at which point the aggregated and coalesced toner particles are recovered and optionally washed and dried.

Dilute solutions of flocculates or aggregating agents may be used to optimize particle aggregation time with as little fouling and coarse particle formation as possible. Examples of flocculates or aggregating agents may include polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIRAPOL™ and ALKAQUAT™ (available from Alkaril Chemical Company), SANIZOL™ (benzalkonium chloride) (available from Kao Chemicals), and the like, and mixtures thereof.

In embodiments, the flocculates or aggregating agents may be used in an amount of from about (0.01 weight percent to about 10 weight percent of the toner composition, such as from about 0.02 weight percent to about 5 weight percent or from about 0.05 weight percent to about 2 weight percent.

In alternative embodiments, the binder resin may be a polyester resin. Examples of suitable polyester resins include polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexylene-adipate, polylheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(propoxylated bisphenol-fumarate), poly(propoxylated bisphenol-succinate), poly(propoxylated bisphenol-adipate), poly(propoxylated bisphenol-glutarate) and mixtures thereof.

A polyester toner, which is known in the art, is thus also suitable for use herein. Polyester toner particles, created by the EA process, are illustrated in a number of patents, such as U.S. Pat. Nos. 5,593,807, 5,290,654. 5,308,734, and 5,370,963, each of which is incorporated herein by reference in their entirety. Further examples of suitable polyester toner particles include those having sodio-sulfonated polyester resin as disclosed in a number of patents, such as U.S. Pat. Nos. 6,387,581 and 6,395,445, each of which is incorporated herein by reference in their entirety. The polyester may comprise any of the polyester materials described in the aforementioned references. As these references fully describe polyester EA toners and methods of making the same, further discussion on these points is omitted herein.

In polyester toner preparation, a resin emulsion is transferred into a glass resin kettle equipped with a thermal probe and mechanical stirrer. A pigment is added into this reactor while stirring. Additionally, a wax dispersion may optionally be added for oiliness systems. The pigmented mixture is stirred and heated using an external water bath to a desired temperature, for example from about 40° C. to about 70° C., such as from about 45° C. to about 70° C. or from about 40° C. to about 65° C., at a rate from about 0.25° C./min, to about 2° C./min., such as from about 0.5° C./min. to about 2° C./min. or from about 0.25° C./min. to about 1.5° C./min. A freshly prepared solution of a coalescing agent is made to ensure efficacy of the aggregation. Once the emulsion reaches the desired temperature, the solution of a coalescing agent is pumped into the mixture, for example through a peristaltic pump. The addition of the solution of coalescing agent is completed after, for example, from about 1 hour to about 5 hours, such as from about 1 hour to about 4 hours or from about 1.5 hours to about 5 hours, and the mixture is additionally stirred from about 1 hour to about 4 hours, such as from about 1 hour to about 3.5 hours or from about 1.5 hours to about 4 hours. The temperature of the reactor may then be raised towards the end of the reaction to, for example, from about 45° C. to about 75° C., such as from about 50° C. to about 75° C. or from about 45° C. to about 70° C., to ensure spheridization and complete coalescence. The mixture is then quenched with deionized water that is at a temperature of, for examples from about 29° C. to about 45° C., such as from about 32° C. to about 45° C. or from about 29° C. to about 41° C. The slurry is then washed and dried.

Too little wax on the surface of EA toner particles may result in the toner exhibiting marks on copy print defect. However, a certain amount of wax on the surface of the EA toner particles is necessary to release the toner particles from the fuser roll during printing as discussed below. The toner particles described herein will have a marks on copy print value of less than about 0.006 percent area coverage per page as quantified by any known imaging anyalsis software. Such a value is an improvement over known toner particles, which may have a marks on copy print value of greater than about 0.006 percent area coverage per page.

To decrease the marks on copy print defects, it is desired to provide a certain amount of wax content on the surface of the EA toner particles. As used herein, the "surface" of the toner particles refers to the external surface of the toner particle down to a depth of from about 1 nm to about 7 nm, such as from about 2 nm to about 5 nm of the individual toner particles. Thus, the surface of the toner is from about 1 nm to about 7 nm, such as from about 2 nm to about 5 nm thick. If the surface oxygen value is 0 then the entire surface of the particles would be covered with wax, that is, there would be 100 percent surface coverage. This would correspond to the measuring the atomic percent oxygen level of <0.1 atomic percent oxygen value.

As explained above, the waxes suitable for use herein are substantially free of oxygen. The amount of wax content on the surface of the EA toner particles may be measured using X-ray photoelectron spectroscopy (XPS), in which the amount of elemental oxygen on the surface of the LA toner is measured. As the amount of elemental oxygen on the surface of the toner decreases, the amount of wax on the surface of the toner increases.

In embodiments, it is desired that the atomic percent oxygen on the surface of the toner particles is less than 18 atomic percent oxygen relative to a total atomic percent of 100 for all elements on the surface of the toner particles, such as from about 0 atomic percent oxygen to about 15 atomic percent oxygen or from about 0.01 atomic percent oxygen to about 12 atomic percent oxygen.

The atomic percent oxygen on the surface of the toner may be controlled by a variety of factors. For example, utilizing a wax having a lower molecular weight will decrease the atomic percent oxygen on the surface of the toner because due to the lower molecular weight, the wax is more mobile and more of such a wax will be found on the surface of the toner. Because the wax is substantially free of oxygen, the amount of oxygen on the surface of the toner will be decreased. In embodiments, if a wax having a molecular weight of from about 400 to 750 is utilized, the atomic percent oxygen on the surface of the toner particles may be from about 0 to about 9, such as from 2 to about 8. In further embodiments, if a wax having a molecular weight of from 750 to about 1000 is utilized, the atomic percent oxygen on the surface of the toner particles may be from about 0 to about 15, such as from about 5 to about 15. Thus, when the wax has a higher molecular weight, it is less mobile and less wax will be on the surface of the toner particles, while the atomic percent oxygen on the surface of the toner particles will be greater.

Yet another method of controlling the atomic percent oxygen on the surface of the toner includes that loading amount of wax in the toner particle formulation. For example, the higher loading amount of wax results in lower percent oxygen, and more wax on the surface particles.

Further, the coalescence time, the coalescence temperature, and the cooling rate after coalescence can also affect the percent oxygen, which correlates to the amount of wax on the surface of the toner particles. For example, a longer coalescence time may increase the amount of wax on the surface of the toner particles, thereby decreasing the atomic percent oxygen on the surface of the toner particles. A longer coalescence time allows additional time for the wax to migrate to the surface of the toner particles. Thus, with a longer coalescence time, the amount of wax on the surface of the toner particles increases, and the amount of atomic percent oxygen on the surface of the toner particles decreases. In addition, by changing the cooling rate, such as by a slower cooling of the particles after coalescence, allows more time for the wax to migrate to the particle surface and thus may result in a lower atomic percent oxygen on the surface of the toner particles.

Changes in particle drying conditions at different scales, that is, a manufacturing scale or a 20 gallon scale, can also affect the measured percent oxygen due to smearing of the wax on the surface of the toner particles, thus reducing the percent oxygen on the surface of the toner particles.

XPS instruments are known in the art, and consist of an X-ray source, an energy analyzer for the photoelectrons, and an electron detector. The analysis and detection of photoelectrons requires the sample to be placed in a high vacuum chamber. Because the photoelectron energy depends on X-ray energy, the excitation source must be monochromatic. The energy of the photoelectrons is analyzed by an electron analyzer, and the photoelectrons are detected by multi-channel detector such as a micro-channel plate.

In embodiments, described herein is a method of measuring the amount of wax on the surface of EA toner particles as atomic percent surface oxygen by XPS. XPS is a surface analysis technique that provides elemental, chemical state, and quantitative analysis of from about 1 nm to about 7 nm of a toner particle's surface, such as from about 2 nm to about 5 nm of a toner particle's surface. In other words, the surface analysis is a measurement of from about 1 nm to about 7 nm of a toner particle's surface depth, such as from about/nm to about 5 nm of a toner particle's surface depth, such that the measurement occurs from the outer surface of the toner particles to from about 1 nm to 7 nm down into the surface of the toner particles. The analysis is done by irradiating a sample with soft X-rays to ionize atoms and release core-level photoelectrons. The kinetic energy of the escaping photoelectrons limits the depth from which it can emerge. This is what gives XPS its high surface sensitivity and a sampling depth of only a few nanometers. Photoelectrons are collected and analyzed by the XPS instrument to produce a spectrum of emission intensity versus electron binding energy. Since each element has a unique set of binding energies, XPS can be used to identify the elements on the surface. Also, peak areas at nominal binding energies can be used to quantify concentration of the elements.

The size of the formed EA particles may be from about 3 μm to about 8 μm, such as a toner particle size of from about 4.5 μm to about 7 μm or from about 5 μm to about 6 μm.

The circularity may be determined using the known Malvern Sysmex Flow Particle Image Analyzer FPIA-2100. The circularity is a measure of the particles closeness to a perfect sphere. A circularity of 1.0 identifies a particle having the shape of a perfect circular sphere. The toner particles described herein may have a circularity of from about 0.9 to about 1.0, such as from about 0.93 to about 1.0 or from about 0.95 to about 1.0.

The developed toner mass per unit area (TMA) suitable for the printed images from the toner described herein may be in the range of from about 0.35 $mg/cm^2$ to about 0.55 $mg/cm^2$, such as from about 0.4 $mg/cm^2$ to 0.5 about $mg/cm^2$ or from about 0.43 $mg/cm^2$ to about 0.47 $mg/cm^2$.

The onset Tg (glass transition temperature) of the toner particles may be from about 40° C. to about 70° C., such as from about 45° C. to about 65° C. or from about 50° C. to about 63° C.

The toner particles also preferably have a size such that the upper geometric standard deviation (GSDv) by volume for (D84/D50) is in the range of from about 1.15 to about 1.27, such as from about 1.18 to about 1.25. The particle diameters at which a cumulative percentage of 50% of the total toner particles are attained are defined as volume D50, which are from about 5.45 to about 5.88, such as from about 5.47 to about 5.85. The particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The upper GSDv value for the toner particles indicates that the toner particles are made to have a very narrow particle size distribution.

It may also be desirable to control the toner particle size and limit the amount of both fine and coarse toner particles in the toner. The toner particles may have a very narrow particle size distribution with a lower number ratio geometric standard deviation (GSDn), which is express as (number D50/number D16), of from about 1.20 to about 1.30, such as from about 1.22 to about 1.29.

The toner particles disclosed herein may be suitable for use in any development system. In embodiments, the toner particles may be suitable for use in a conductive magnetic brush (CMB) developments system. Such a CMB developer can be used in various systems, for example a hybrid jumping (HJD) system or a hybrid scavengeless development (HSD) system. In alternative embodiments, the toner particles may be used in development systems using a Teflon-on-Silicon (TOS) fuser member. In vet further embodiments, the toner particles described herein may be used in a development system having a hard fuser member.

In an image forming process, an image forming device is used to form a print, typically a copy of an original image. An image forming device imaging member (for example, a photoconductive member) including a photoconductive insulating layer on a conductive layer, is imaged by first uniformly electrostatically charging the surface of the photoconductive insulating layer. The member is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing the toner particles, for example from a developer composition, on the surface of the photoconductive insulating layer.

The resulting visible toner image can be transferred to a suitable image receiving substrate such as paper and the like.

To fix the toner to the image receiving substrate, such as a sheet of paper or transparency, hot roll and belt fixing is commonly used. In this method, the image receiving substrate with the toner image thereon is transported between a heated fuser member and a pressure member with the image face contacting the fuser member. Upon contact with the heated fuser member, the toner melts and adheres to the image receiving medium, forming a fixed image. This fixing system is very advantageous in heat transfer efficiency and is especially suited for high speed electroplhotographic processes. In embodiments, the fixing system may be a free belt nip fuser.

In embodiments, the fuser may be a hard fuser member. In alternative embodiments, the fuser member suitable for use herein comprises at least a substrate and an outer layer. Any suitable substrate can be selected for the fuser member. The fuser member substrate may be a roll, belt, flat surface, sheet, film, drelt (a cross between a drum or a roller), or other suitable shape used in the fixing of thermoplastic toner images to a suitable copy substrate. Typically, the fuser member is a roll made of a hollow cylindrical metal core, such as copper, aluminum, stainless steel, or certain plastic materials chosen to maintain rigidity and structural integrity, as well as being capable of having a polymeric material coated thereon and adhered firmly thereto. The supporting substrate may be a cylindrical sleeve, preferably with an outer fluoropolymeric layer of from about 1 to about 6 millimeters. In one embodiment, the core, which can be an aluminum or steel cylinder, is degreased with a solvent and cleaned with an abrasive cleaner prior to being primed with a primer, such as DOW CORNING® 1200, which can be sprayed, brushed, or dipped, followed by air drying under ambient conditions for thirty minutes and then baked at about 150° C. for about 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

When the fuser member is a belt, the substrate can be of any desired or suitable material, including plastics, such as ULTEM®, available from General Electric, ULTICPEK®, available from BASF, PPS (polyphenylene sulfide) sold under the tradenames FORTRON®, available from Hoechst Celanese, RYTON R-4®, available from Phillips Petroleum, and SUPEC®, available from General Electric; PAI (polyamide imide), sold under the tradename TORLON® 7130, available from Amoco; polyketone (PK), sold under the tradename KADEL® E1230, available from Amoco; PI (polyimide); polyaramide; PEEK (polyether ether ketone), sold under the tradename PEEK 450GL30, available from Victrex; polyphthalamide sold under the tradename AMODEL®, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PFA (perfluoroalkoxy); FEP (fluorinated ethylene propylene); liquid crystalline resin (XYDAR®), available from Amoco; and the like, as well as mixtures thereof. These plastics can be filled with glass or other minerals to enhance their mechanical strength without changing their thermal properties. In embodiments, the plastic comprises a high temperature plastic with superior mechanical strength, such as polyphenylene sulfide, polyamide imide, polyimide, polyketone, polyphthalarnide, polyether ether ketone, polyethersulfone, and polyetherimide. Suitable materials also include silicone rubbers. Examples of belt-configuration fuser members are disclosed in, for example, U.S. Pat. Nos. 5,487,707 and 5,514,436, the disclosures of each of which are totally incorporated herein by reference. A method for manufacturing reinforced seamless belts is disclosed in, for example, U.S. Pat. No. 5,409,557, the disclosure of which is totally incorporated herein by reference.

The fuser member may include an intermediate layer, which can be of any suitable or desired material. For example, the intermediate layer can comprise a silicone rubber of a thickness sufficient to form a conformable layer, Suitable silicone rubbers include room temperature vulcanization (RTV) silicone rubbers, high temperature vulcanization (HTV) silicone rubbers, and low temperature vulcanization (LTV) silicone rubbers. These rubbers are known and are readily available commercially such as SILASTIC® 735 black RTV and SILASTIC® 732 RTV, both available from Dow Coming, and 106 RTV Silicone Rubber and 90 RTV Silicone Rubber, both available from General Electric. Other suitable silicone materials include the silanes, siloxanes (preferably polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers. The intermediate layer may have a thickness of from about 0.05 to about 10 millimeters, such from about 0.1 to about 5 millimeters or from about 1 to about 3 millimeters.

The layers of the fuser member can be coated on the fuser member substrate by any desired or suitable means, including normal spraying, dipping, and tumble spraying techniques. A flow coating apparatus as described in U.S. Pat. No. 6,408,753, the disclosure of which is totally incorporated herein by reference, can also be used to flow coat a series of fuser members. In embodiments, the polymers may be diluted with a solvent, such as an environmentally friendly solvent, prior to application to the fuser substrate. Alternative methods that are well known in the art, however, may be used for coating layers.

The outer layer of the fuser member may comprise a fluoropolymer such as polytetrafluoroethylene (PTFE), fluorinated ethylenepropylene copolymer (FEP), polyfluoroalkoxy (PFA), perfluoroalkoxy polytetrafluoroethylene (PFA TEFLON®), ethylene chlorotrifluoro ethylene (ECTFE), ethylene tetrafluoroethylene (ETFE), polytetratluoroethylene perfluoromethylvinylether copolymer (MFA), combinations thereof and the like.

In embodiments, the outer layer may further comprise at least one filler. Examples of fillers suitable for use herein include a metal filler, a metal oxide filler, a doped metal oxide filler, a carbon filler, a polymer filler, a ceramic filler, and mixtures thereof.

In embodiments, an optional adhesive layer may be located between the substrate and the intermediate layer. In further embodiments, the optional adhesive layer may be provided between the intermediate layer and the outer layer. The optional adhesive intermediate layer may be selected from, for example, epoxy resins and polysiloxanes.

As explained above, a controlled amount of wax on the surface of the toner is required to prevent or reduce the marks on copy print defects. However, a certain amount of wax may be present on the surface of the toner particles in order to assist in releasing such toner particles from a fuser member in the development system. Depending upon the type of development system in an image forming process, the toner particles may have a different amount of wax on the surface thereof to reduce the marks on copy print defect.

For example, the atomic percent oxygen on the surface of the toner particles should be lower when hard fuser rolls are utilized than when a softer fuser roll is utilized. When a development system having a hard fuser roll is utilized, the atomic percent oxygen on the surface of the toner particles may be less than about 9, such as from about 0 to about 8 atomic percent oxygen or from about 0.01 to about 7 atomic percent oxygen on the surface of the toner particles. However, when a development system having a softer fuser roll is utilized, the atomic percent oxygen on the surface of the toner may be higher, for example, less than about 15 atomic percent oxygen, such as from about 0 to about 13.5 atomic percent oxygen or from about 0.01 to about 12 atomic percent oxygen.

The method of measuring the atomic percent oxygen on the surface of the toner particles may be utilized during the manufacturing process in order to achieve uniform toner particles from batch to batch. If the amount of wax on the surface of the toner particles, as evidenced by the atomic percent oxygen on the surface of the toner particles, is outside of the ranges specified herein, the process of manufacturing or producing the toner particles may be altered to achieve toner particles having the specified amount of wax on the surface thereof. For example, the wax utilized in the process may be altered by including a lower molecular weight wax in order to increase the amount of wax on the surface of the toner particles, the coalescence time may be increased or the cooling rate after particle coalescence can be reduced to increase the amount of wax on the surface of the toner particles, changing the manufacturing scale to control the amount of wax on the surface of the toner particles, etc. From the description herein, one of ordinary skill in the art would understand how to modify the process of making the toner particles disclosed herein in order to achieve toner particles having the desired amount of wax on the surface therefor.

Embodiments described above will now be further illustrated by way of the following examples.

EXAMPLES

XPS Sample-Preparation

The sample was presented to the X-ray source by depositing the material, that is, toner particles, onto a sample holder.

Toner Examples

The following examples are grouped according to different styrene/acrylate emulsion aggregation particle formulations.

Toner Particle Formulation I

Examples 1 and 3-9 all contain about 10.5 weight percent POLYWAX 655, Example 2 contains about 11.5 weight percent POLYWAX 655, and Examples 10 contains about 11.5 weight percent POLYWAX 725.

TABLE 1

Toner Particle Batches Prepared At Different Scales With POLYWAX 655 And POLYWAX 725 Demonstrating Variation In Surface Oxygen As A Function Of Particle Process Parameters, Wax Loading And Molecular Weight

| TONER | Particle Scale | Wax Type | Wax Loading | Particle Process Parameters (Coalescence Time/Cooling Rate/ Coalescence Temperature) | % Oxygen |
|---|---|---|---|---|---|
| 1 | 5000 Gal | POLYWAX 655 | 10.5 | 2.5 hrs; 0.74° C./min; 96° C. | 6.8 |
| 2 | 5000 Gal | POLYWAX 655 | 11.5 | 2.5 hrs; 0.45° C./min; 96° C. | 6.7 |
| 3 | 5000 Gal | POLYWAX | 10.5 | 2.5 hrs; 0.45° C./min; 96° C. | 6.5 |

TABLE 1-continued

Toner Particle Batches Prepared At Different Scales With POLYWAX 655 And POLYWAX 725 Demonstrating Variation In Surface Oxygen As A Function Of Particle Process Parameters, Wax Loading And Molecular Weight

| TONER | Particle Scale | Wax Type | Wax Loading | Particle Process Parameters (Coalescence Time/Cooling Rate/ Coalescence Temperature) | % Oxygen |
|---|---|---|---|---|---|
| | | 655 | | | |
| 4 | 5000 Gal | POLYWAX 655 | 10.5 | 5 hrs; 0.3° C./min; 98° C. | 5.5 |
| 5 | 500 Gal | POLYWAX 655 | 10.5 | 1.5 hrs; 0.9° C./min; 94° C. | 6.4 |
| 6 | 500 Gal | POLYWAX 655 | 10.5 | 2.5 hrs; 0.71° C./min; 96° C. | 5.0 |
| 7 | 500 Gal | POLYWAX 655 | 10.5 | 2.5 hrs; 0.44° C./min; 96° C. | 3.63 |
| 8 | 500 Gal | POLYWAX 655 | 10.5 | 1.5 hrs; 0.9° C./min; 94° C. | 6.16 |
| 9 | 500 Gal | POLYWAX 655 | 10.5 | 5 hrs; 0.3° C./min; 98° C. | 4.22 |
| 10 | 5000 Gal | POLYWAX 725 | 11.5 | 2.5 hrs; 0.75° C./min; 96° C. | 8.1 |

Different molecular weights of polyethylene wax were evaluated. Particle batches containing the higher molecular weight wax, POLYWAX 725, had a higher percent oxygen values (>about 6) due to less wax on the particle surface as compared to the lower molecular weight wax, POLYWAX 655, which migrates to the particle surface more than POLYWAX 725 resulting in lower percent oxygen values at the same reaction scale and under identical process conditions.

Toner Example 1

10.5% POLYWAX 655, 8% Carbon Black, 10% Gel latex, 71.5% High Tg Latex

All particle examples were normalized to the 20 gallon scale highlighting the particle process parameters that are responsible for the largest variation in measured percent oxygen.

Toner particles were prepared by mixing together about 10.7 kilograms of high Tg latex having a solids loading of about 41.6 weight percent, about 3.45 kilograms of POLYWAX 655 emulsion having a solids loading of about 31 weight percent, about 5 kilograms of black pigment dispersion (REGAL 330) having a solids loading of about 17 weight percent, about 4 kilograms of gel latex having a solids content of about 25 weight percent with about 32 kilograms of de-ionized water in a vessel while being stirred using an IKA Ultra Turrax® T50 homogenizer operating at about 4,000 rpm. After about 5 minutes of homogenizing, slow controlled addition of about 1.7 kilograms of a flocculent mixture containing about 170 grams poly(aluminum chloride) mixture and about 1530 grams of 0.02 molar nitric acid solution was performed. The reactor jacket temperature was set to about 57° C., and the particles were aggregated to a target size of about 4.8 micron as measured with a Coulter Counter. Upon reaching about 4.8 microns measured average size, about an additional 6.9 kilograms of high Tg latex was added, and the particles grew to the target particle size of about 5.85 to about 5.9 microns. The particle size was frozen by adjusting the reactor mixture pH to about 6.0 with 1 molar sodium hydroxide solution. Thereafter, the reactor mixture was heated at about 0.35° C. per minute to a temperature of about 85° C., followed by adjusting the reactor mixture pH to about 3.9 with 0.3 M nitric acid solution. The reaction mixture was then ramped to about 96° C. at about 0.35° C. per minute. At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7 with 1 percent sodium hydroxide solution. Particle coalescence was continued for a total of about 2.5 hours at about 96° C. The particles were cooled at a control rate of about 0.74° C. per minute to about 85° C. and then cooled to about 63° C. At about 63° C., the slurry was treated with about 4 percent sodium hydroxide solution to about pH 10 for about 60 minutes, followed by cooling to about room temperature, approximately 25° C. The toner of this mixture comprised about 71.5 percent of styrene/acrylate polymer, about 8 percent of REGAL 330 pigment, about 10.5 percent by weight of POLYWAX 655 and about 10 percent by weight of gel latex. After removal of the mother liquor, the particles were washed 5 times consisting of 3 washes with de-ionized water at room temperature, one wash carried out at a pH of about 4 at about 40° C., and finally the last wash with de-ionized water at about room temperature. The amount of acid used for the pH 4 wash was about 200 grams of 0.3 molar nitric acid. After drying the particles in an Aljet dryer, the final volume median particle size d50=6.38 microns, GSD by volume of about 1.20, GSD by number of about 1.28, percent fines (<about 4 microns) of about 8.5 percent, particle circularity of about 0.97 and measured percent oxygen by XPS was about 6.75.

Toner Example 2

11.5% POLYWAX 655, 8% Carbon Black, 10% Gel Latex, 70.5% High Tg Latex

Toner particles were prepared by mixing together about 10.5 kilograms of high Tg latex having a solids loading of about 41.57 weight percent, about 3.8 kilograms of POLYWAX 655 emulsion having a solids loading of about 31 weight percent, about 5 kilograms of black pigment dispersion (REGAL 330) having a solids loading of about 17 weight percent, about 4 kilograms of gel latex having a solids content of about 25 weight percent with about 31.9 kilograms of de-ionized water in a vessel while being stirred using an IKA Ultra Turrax® T50 homogenizer operating at about 4,000 rpm. After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles were aggregated to a target size of about 4.8 micron as measured with a Coulter Counter. Upon reaching about 4.8 microns measured average size, about an additional 6.9 kilograms of high Tg latex was added and the particles grew to the target particle size of about 5.85 to about 5.9 microns. The particle size was frozen by adjusting the reactor mixture pH to about 6 with 1 molar sodium hydroxide solution. Thereafter, the reactor mixture was heated at about 0.35° C. per minute to a temperature of about 85° C., followed by adjusting the reactor Mixture pH to about 3.9 with 0.3 M nitric acid solution. The reaction mixture was then ramped to about 96° C. at about 0.35° C. per minute. At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7 with about 1 percent sodium hydroxide solution. Particle coalescence was continued for a total of about 2.5 hours at about 96° C. The particles were cooled at a control rate of about 0.45° C. per minute to about 85° C. and then cooled to about 63° C. At about 63° C., the slurry was treated with about 4 percent sodium hydroxide solution to about pH 10 for about 60 minutes followed by cooling to about room temperature, approximately 25° C. The toner of this mixture comprised about 70.5 percent of styrene/acrylate polymer, about 8 percent of REGAL, 330 pigment, about 11.5 percent by weight of POLYWAX 655 and about 10 percent by weight of gel latex. After removal of the mother liquor, the particles were washed 5 times consisting of 3 washes with de-ionized water at room temperature, one wash carried out at a pH of about 4 at about 40° C., and finally the last wash with de-ionized water at about room temperature. The amount of acid used for the about pH 4 wash was about 200 grams of about 0.3 molar nitric acid. After drying the particles in an Aljet dryer the final volume median particle size d50=5.84 microns, GSD by volume of about 1.20, GSD by number of about 1.29, percent fines (<about 4 microns) of about 16.7% percent particle circularity of about 0.965 and measured percent oxygen by XPS was about 6.7.

Toner Examples 3-9

Examples 3 to 9 consisted of the same particle formulation as Example 1. The variation in measured atomic percent oxygen as shown in Table 1 was due to changes in the particle coalescence process parameters, coalescence temperature, coalescence time and cooling rate at the end of coalescence.

Toner Example 10

11.5% POLYWAX 725, 8% Carbon Black, 10% Gel Latex, 70.5% High Tg Latex

The toner formulation used to prepare Example 10 was the same as Example 9, except that POLYWAX 725 was used instead of POLYWAX 655 at the same reactor loading of about 11.5 weight percent of the particle formulation. The particles were coalesced at about 96° C. for about 2.5 hours. After coalescence, the particles were cooled at a controlled rate of about 0.75° C. per minute to about 85° C. and then cooled to about 63° C. After drying the particles in an Aljet dryer, the final volume median particle size d50=6.25 microns, GSD by volume of about 1.22, GSD by number of about 1.28, percent fines (<about 4.0 microns) of about 10.9 percent, particle circularity of about 0.965 and measured percent oxygen by XPS was about 8.1.

Toner Particle Formulation II

Toner Example 11

12% POLYWAX 725, 10% Carbon Black, 10% Gel Latex, 68% High Tg Latex

The toner particles were prepared by mixing together about 256.1 kilograms of high Tg latex having a solids loading of about 41.6 weight percent, about 103.2 kilogram of POLYWAX 725 wax emulsion having a solids loading of about 31 weight percent, about 164 kilograms of black pigment dispersion (REGAL 330) having a solids loading of about 17 weight percent, about 104 kilograms of gel latex having a solids content of about 25 weight percent with about 811.9 kilograms of de-ionized water in a vessel while being stirred. The entire mixture was homogenized through a Quadro homogenizer loop, and about 44.2 kilograms of a flocculent mixture containing about 4.42 kilograms polyaluminum chloride mixture and about 39.8 kilograms 0.02 molar nitric acid solution was added slowly into the homogenizer loop. The mixture was homogenized for about a further 60 minutes, then the homogenizer was stopped and the loop emptied back into the reactor. The reactor jacket temperature was set to about 59° C. and the particles aggregated to a target size of about 4.8 micron as measured with a Coulter Counter. Upon reaching about 4.8 microns measured average size, about an additional 179.3 kilograms of gel latex was added and the particles were grown to a target particle size of about 5.85 to about 5.9 microns. The particle size was frozen by adjusting the reactor mixture pH to about 6 with about 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute. At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7 with about 1 percent sodium hydroxide solution. Particle coalescence was continued for a total of about 2.5 hours at about 96° C. The particles were cooled at a controlled rate of about 0.6° C. per minute to about 63° C. At about 63° C., the slurry was treated with about 4 percent sodium hydroxide solution to about pH 10 for about 20 minutes, followed by cooling to about room temperature, approximately 25° C. The toner of this mixture comprises about 68 percent of styrene/acrylate polymer, about 10 percent of REGAL 330 pigment, about 12 percent by weight of POLYWAX 725 and about 10 percent by weight of gel latex. The particles were washed 3 times after removal of the mother liquor: one wash with de-ionized water at about room temperature, one wash carried out at a pH of about 4 at about 40° C., and finally the last wash with de-ionized water at about room temperature. After drying the particles in an Aljet dryer, the final average particle size d50=5.89 micron, GSD by volume of about 1.21, GSD by number of about 1.26, percent fines (<about 4 microns) of about 15.7 percent, particle circularity of about 0.959, and toner onset Tg was about 52.7° C. The measured percent oxygen of this particle was about 5.5%.

Toner Example 12

10% Carbon Black, 5% POLYWAX 850 (delayed addition), and 10% Gel Latex

The toner particles were prepared by mixing together about 324.1 kilograms of high Tg latex having a solids loading of about 41.6 weight percent, about 176.6 kilograms of black pigment dispersion (REGAL 330) having a solids loading of about 17 weight percent, about 112 kilograms of gel latex having a solids content of about 25 weight percent with about 776.7 kilograms of de-ionized water in a vessel while being stirred. The entire mixture was homogenized through a Quadro homogenier loop, and about 47.6 kilograms of a flocculent mixture containing about 4.76 kilograms polyaluminum chloride mixture and about 42.8 kilograms of about 0.02 molar nitric acid solution was added slowly into the homogenizer loop. The mixture was homogenized for about a further 20 minutes, then about 46.3 kilograms POLYWAX 850 emulsion having a solids loading of about 31 weight percent was added via the homogenizer loop. The mixture was homogenized for about a further 30 minutes, then the homogenizer was stopped and the loop emptied back into the reactor. The reactor jacket temperature was set to about 59° C., and the particles aggregated to a target size of about 4.8 micron as measured with a Coulter Counter. Upon reaching about 4.8 micron measured average size, about an additional 193.1 kilograms of high Tg latex was added and the particles were grown to a target particle size of about 5.85 to about 5.9 microns. The particle size was frozen by adjusting the reactor mixture pH to about 6 with about 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute. At the start of particle coalescence, the pH was checked but not adjusted. The particle shape was monitored by measuring particle circularity using the Sysmex FPIA shape analyzer. Once the target circularity was achieved (about 0.96), the pH was adjusted to about 7 with about 1 percent sodium hydroxide solution. Particle coalescence was continued for a total of about 2.5 hours at about 96° C. The particles were cooled to about 63° C. At about 63° C., the slurry was treated with about 4 percent sodium hydroxide solution to about pH 10 for about 60 minutes followed by cooling to about room temperature, approximately 25° C. The toner of this mixture comprises about 75 percent of styrene/acrylate polymer, about 10 percent of REGAL 330 pigment, about 5 percent by weight of POLYWAX 850 and about 10 percent by weight of gel latex. The particles were washed 3 times after removal of the mother liquor; 1 wash with de-ionized water at room temperature, one wash carried out at a pH of about 4.0 at about 40° C., and finally the last wash with de-ionized water at room temperature. After drying the particles in an Aljet dryer, the final average particle size d50=5.89 microns, GSD by volume of about 1.2, GSD by number of about 1.23, percent fines (<about 4.0 microns) of about 12.8 percent, particle circularity of about 0.963.

A series of particles were made according to Toner Example 11 (bulk wax) or Toner Example 12 (delayed wax) at the 20 gallon scale, but using latexes of different Tg's and varied wax types and loadings. The toner particles are described in Table 2, and the resulting percent oxygen as measured by XPS is included in Table 2.

TABLE 2

Preparation Of Toner Particles (Carbon Black And Gel Latex Loading As Described In Example 11) With Different Toner Tg's, Wax Types And Wax Loadings

| TONER EXAMPLE | Latex Tg (° C.) | Wax (addition type) | % Wax | % O |
|---|---|---|---|---|
| 11 | 55 | POLYWAX 725 (bulk) | 12 | 5.54 |
| 13 | 55 | POLYWAX 850 (bulk) | 9 | 7.16 |
| 14 | 55 | POLYWAX 725 (bulk) | 9 | 6.33 |
| 15 | 55 | POLYWAX 850 (delayed) | 5 | 8.08 |
| 16 | 55 | POLYWAX 725 (bulk) | 12 | 5.71 |
| 17 | 55 | POLYWAX 655 (bulk) | 12 | 5.11 |
| 18 | 53 | POLYWAX 850 (delayed) | 5 | 7.93 |
| 19 | 53 | POLYWAX 725 (bulk) | 12 | 6.10 |
| 20 | 57 | POLYWAX 850 (delayed) | 5 | 6.10 |
| 21 | 57 | POLYWAX 725 (bulk) | 12 | 5.48 |
| 22 | 59 | POLYWAX 850 (delayed) | 5 | 7.73 |
| 23 | 59 | POLYWAX 725 (bulk) | 12 | 6.21 |

The results clearly demonstrate that wax type is a significant driver of atomic percent oxygen while latex Tg is not. As the molecular weight of the wax is lowered, the amount of wax that comes to the surface is increased, thus lowering the atomic percent oxygen measurement. As seen in the other examples above of Toner Formulation I, chancing the coalescence time, temperature and cooling rate also changes the way that a wax comes to the surface and thus the resulting atomic percent oxygen measured.

Toner Formulation III

Emulsion aggregation toner particle formulations having a high gloss use about 11 percent POLYWAX 655 wax to achieve higher gloss, fusing and release characteristics to enable machine performance. The data listed below was taken from baseline process from 20 gallon and manufacturing. The baseline process consists of final particle size of about 5.6 microns, circularity range of about 0.956 to about 0.970, and about a 3 hour coalescence. The cooling rate was about 0.6° C. per minute. During cooling, the particles became sticky. A pH adjustment before cooling was implemented to decrease particle stickiness. The XPS atomic percent oxygen content was a supplemental property and was monitored. It was observed that the 20-gallon exhibits more wax on the surface than in manufacturing. This is believed to be due to scaling affects. The ranges observed have shown acceptable machine performance to date. In manufacturing, 6 different lots of the POLYWAX 655 dispersions were analyzed. The coalescence time in producing Toner Example 28 was increased to about 3.5 hours, which is a longer coalescence time and may have contributed to more wax on the surface of the toner particles, and therefore a lower atomic percent oxygen value on the surface of the toner particles.

TABLE 3

Black Baseline Formulation

| MATERIALS | AMOUNT (kg) |
|---|---|
| Latex core | 53.5 parts |
| High Tg Latex Shell | 28 parts |
| PAC Flocculant | 0.18 pph |
| VERSENE(100) | 0.94 pph |
| Colorant | 1.0 part |
| POLYWAX 655 | 11 parts |
| REGAL 330 | 6.5 parts |

The amounts of the latex core, high Tg latex shell, colorant, POLYWAX 655 and REGAL 330 equals 100 parts, while the flocculent and VERSENE (100) are considered to be additional additives.

TABLE 4

| Data Below For Shows XPS Atomic Percent Oxygen Data For 20 Gallon And Manufacturing Scale | | | |
|---|---|---|---|
| TONER EXAMPLE (Manufacturing Scale) | Atomic Percent Oxygen | TONER EXAMPLE (20 Gallon Scale) | Atomic Percent Oxygen |
| 24 | 8.37 | 36 | 7.33 |
| 25 | 8.59 | 37 | 7.09 |
| 26 | 8.32 | 38 | 6.85 |
| 27 | 8.84 | 39 | 7.35 |
| 28 | 8.1 | 40 | 7.33 |
| 29 | 8.52 | 41 | 7.04 |
| 30 | 8.57 | | |
| 31 | 8.69 | | |
| 32 | 8.55 | | |
| 33 | 8.37 | | |
| 34 | 8.42 | | |
| 35 | 8.52 | | |

It will be appreciated that various of the above-disclosed and other features and functions, or alternatives thereof; may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. Toner particles comprising a wax, a binder resin and a colorant, wherein a surface of individual ones of the toner particles comprises less than 8 atomic percent oxygen in relation to a total atomic percent of 100 for all elements on the surface of the individual toner particles.

2. The toner particles of claim 1, wherein the surface of the individual toner particles includes to a depth into the toner particle of from about 1 nm to about 7 nm.

3. The toner particles of claim 1, wherein the toner particles are emulsion aggregation toner particles.

4. The toner particles of claim 1, wherein the wax is an aliphatic wax, a polyethylene, a polypropylene, or mixtures thereof.

5. The toner particles of claim 1, wherein the binder resin is derived from a high glass transition temperature latex and a gel latex.

6. The toner particles of claim 5, wherein the gel latex comprises from about 30 weight percent to about 99.9 weight percent styrene, from about 5 weight percent to about 50 weight percent butyl acrylate, from about 0.05 weight percent to about 15 weight percent of a carboxyl acid group containing monomer, and 0.25 weight percent to about 10 weight percent crosslinking agent.

7. The toner particles of claim 5, wherein the high glass transition temperature latex is selected from the group consisting of styrene acrylates, styrene methacrylates, butadienes, isoprene, acrylonitrile, acrylic acid, methacrylic acid, beta-carboxyethylacrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly (styrene-butyl acrylate-acrylonitrile), poly(styrene-butyl acrylate-acrylonitrile-acrylic acid), and styrene/butyl acrylate/carboxylic acid terpolymers, styrene/butyl acrylate/beta-carboxyethylacrylate terpolymers, and mixtures thereof.

8. The toner particles of claim 1, wherein the binder resin comprises at least one polyester resin.

9. The toner particles of claim 8, wherein the polyester resin is selected from the group consisting of polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly (propoxylated bisphenol-fumarate), poly(propoxylated bisphenol-succinate), poly(propoxylated bisphenol-adipate), poly(propoxylated bisphenol-glutarate) and mixtures thereof.

10. The toner particles of claim 1, wherein the weight average molecular weight of the wax is from about 400 to 750.

11. The toner particles of claim 1, wherein the weight average molecular weight of the wax is from 750 to about 1000.

12. The toner particles of claim 1, wherein a marks on copy print defect value is less than about 0.006 percent area coverage per page.

13. A process for making emulsion aggregation toner particles, comprising:

forming an emulsion comprised of a binder resin, a wax and a colorant;

aggregating particles from the emulsion to a size from about 3 to about 20 microns;

halting the aggregating of the particles;

coalescing the particles to form toner particles; and measuring the atomic percent oxygen on a surface of at least one of the toner particles and controlling the atomic percent oxygen on the surface of individual ones of the toner particles whereby the surface of the individual toner particles comprises less than 8 atomic percent oxygen in relation to a total atomic percent of 100 for all elements on the surface of the toner particle.

14. The process of claim 13, wherein the surface of the individual toner particles includes to a depth into the toner particle of from about 1 nm to about 7 nm.

15. The process of claim 13, wherein controlling the atomic percent oxygen comprises altering the weight average molecular weight of the wax and/or altering a length of time of the coalescing.

16. An image forming process, comprising:

forming an electrostatic image on a photoconductive member;

developing the electrostatic image to form a visible image by depositing emulsion aggregation toner particles on a surface of the photoconductive member; and transferring the visible image to a substrate and fixing the visible image to the substrate with a fuser member;

wherein the emulsion aggregation toner particles comprise a binder resin, a wax, and a colorant, wherein a surface of individual ones of the toner particles comprises less than 8 atomic percent oxygen in relation to a total atomic percent of 100 for all elements on the surface of the toner particle, and wherein the fuser member is a hard fuser member or comprises a substrate and an outer layer comprising a fluoropolymer.

17. The image forming process of claim 16, wherein the surface of the individual toner particles includes to a depth into the toner particle of from about 1 nm to about 7 nm.

18. Toner particles comprising emulsion aggregation particles including a polyethylene wax, a binder resin and a colorant, wherein a weight average molecular weight of the polyethylene wax is from about 400 to 750 and an atomic percent oxygen on a surface of individual ones of the toner particles is from about 0 to about 9 or wherein the weight average molecular weight of the polyethylene wax is from more than 750 to about 1000 and the atomic percent oxygen on a surface of individual ones of the toner particles is from about 5 to about 15.

* * * * *